United States Patent [19]

Margulies

[11] Patent Number: 4,531,644

[45] Date of Patent: Jul. 30, 1985

[54] STORAGE AND DELIVERY MAGAZINE FOR SKIS

[76] Inventor: David K. Margulies, 4650 S. 1884 East, Salt Lake City, Utah 84117

[21] Appl. No.: 127,945

[22] Filed: Mar. 7, 1980

[51] Int. Cl.[3] ..... A47F 7/00

[52] U.S. Cl. ..... 211/70.5; 211/60.1; 211/162

[58] Field of Search ..... 211/162, 34, 70.5, 60.1

[56] References Cited

U.S. PATENT DOCUMENTS

| | | | |
|---|---|---|---|
| 3,499,539 | 3/1981 | Fischer | 211/162 |
| 3,890,197 | 6/1975 | Butts | 211/60 R |
| 4,084,867 | 4/1978 | Putt | 211/34 |

FOREIGN PATENT DOCUMENTS

| | | | |
|---|---|---|---|
| 2714304 | 10/1978 | Fed. Rep. of Germany | 211/162 |

*Primary Examiner*—John E. Murtagh

*Attorney, Agent, or Firm*—Trask & Britt

[57] ABSTRACT

A system for storing and unloading skis from a magazine having a plurality of tracks and gondola holders suspended from said tracks. In operation, skis are suspended from retractable arms mounted to the gondola holders and biased toward a vertical position to swing out of the way when skis are removed from the arms. The tracks may be sloped toward the point of access to the magazine for closer packing. Also, the gondola holders may have staggered sizes to offset the tips of the skis for closer packing.

9 Claims, 4 Drawing Figures

STORAGE AND DELIVERY MAGAZINE FOR SKIS

BACKGROUND OF THE INVENTION

1. Field

This invention pertains to storage and delivery systems for skis. It provides a compact magazine system for retrieving various sizes and styles of skis from storage.

2. State of the Art

Various fixed bracket ski storage systems are known, such as those described in Swiss Pat. No. 411268 (Vogel) and German Pat. No. 2600121 (Zisterer). These fixed bracket systems made no provision for moving skis stored at the rear of an area toward the front of that area as skis are removed. As a consequence, relatively few pair of the stored skis can be retrieved from a location at the front of the storage area. Vogel attempts to solve this problem through the use of hinged fixed bracket mounts which swing open to expose skis stored toward the rear. U.S. Pat. No. 4,084,867 (Putt) relies upon fixed brackets attached to slideable mounts to expose skis stored toward the rear. Both Vogel and Putt require extensive space to accommodate opening of the brackets for unloading.

Other storage systems have attempted to expose articles stored toward the rear. For example, U.S. Pat. No. 3,780,873 suggests slideable stackers, while U.S. Pat. Nos. 3,612,288 and 3,045,831 disclose hinged display racks. None of these systems are suitable for the storage and dispensing of elongated heavy objects such as skis.

There remains a need for a storage system capable of storing skis of various sizes and styles in a relatively small space but from which skis may be retrieved from a small access region.

SUMMARY OF THE INVENTION

The present invention comprises generally a magazine including a plurality of structural tracks; a plurality of gondola holders suspended from and adapted to move along each of those tracks and each adapted to hold a single pair of skis (preferably at the tip ends); and support members to elevate the tracks sufficiently to hold the tails of the skis clear above the floor. Ideally, the support members are adjustable in length so that the tracks may be sloped toward the front of the magazine. The gondola holders will then tend to move in that direction, carrying stored skis with them.

The magazine of this invention is designed to store skis of various sizes and lengths in the least amount of area possible. Also, it is designed to enable clerks to remove easily the proper style and size of skis from storage from a single aisle, thereby avoiding wasted motion.

According to certain preferred embodiments, the magazine may be quickly assembled for use and disassembled for storage between seasons by means of simple fasteners.

DESCRIPTION OF THE DRAWINGS

In the drawings, which illustrate that which is presently regarded as the best mode for carrying out the invention.

DESCRIPTION OF THE ILLUSTRATED EMBODIMENT

Figure 1:
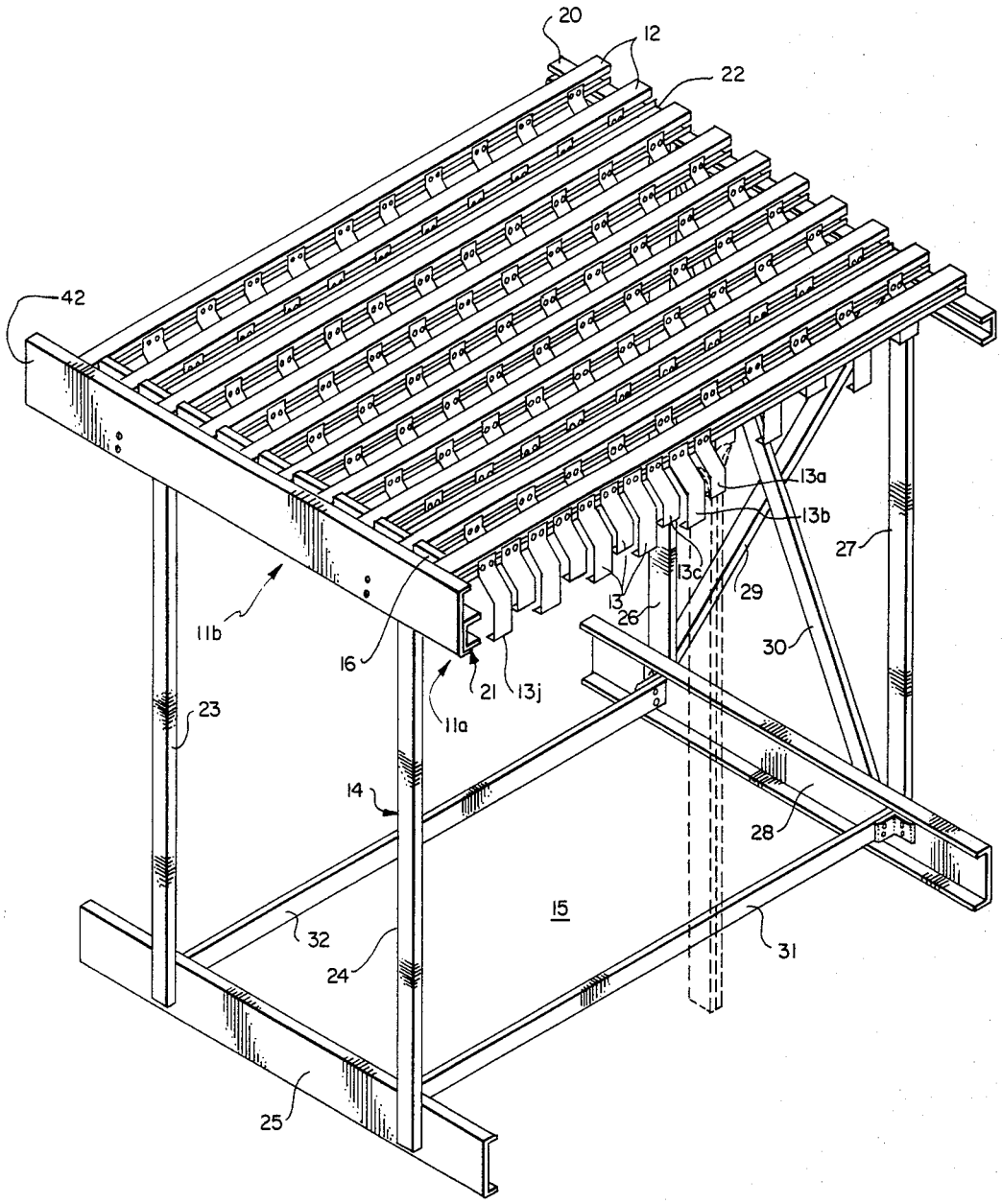
FIG. 1 is a partially schematic illustration of a complete magazine.

Generally, applicant's storage and delivery magazine 11 for skis comprises a plurality of structural tracks 12; a plurality of gondola holders 13 suspended from each track and adapted to hold a single pair of skis (preferably at the tip ends); and support members shown as a plurality of legs 23, 24, 26, 27, designated generally as 14, to elevate the tracks sufficiently to hold the tails of the skis clear above a base, designated generally as 15. The base 15 is usually the floor, but other structures may function as a base 15 to accommodate cabinet arrangements, shelf storage areas and the like. Ideally, the support members 14 are adjustable in length so that the tracks 12 may be sloped toward a point of access 11*a* near the front 11*b* of the magazine 11.

Sloping the tracks 12 toward the point of access 11*a* to the magazine 11 causes the loaded gondola holder 13 to move toward that point for closer packing. The closer packing enables clerks to remove the skis with a minimum of effort even if skis are stored on the gondola holder 13 of a track farthest away from the point of access 11*a*. Also, as a gondola holder 13 is unloaded, it (and consequently all of the other gondolas 13 on the track) moves toward the point of access 11*a* to fill the space occupied by the removed pair of skis.

Leveling means, designated generally as 16, may also be used to slope the tracks 12 toward the point of access 11*a* to the magazine 11. Leveling means 16 enable the slope of the tracks 12 to be adjusted to provide sufficient slope to compensate for any slope irregularities of the floor. Leveling means 16 also allow the tracks 12 to be adjusted for different weights and lengths of skis suspended from the gondola holders 13. The leveling means 16 enable the tracks 12 to be sloped sufficiently that loaded gondola holders 13 will move toward the point of access 11*a* without excessive pressure or strain being placed on adjacent gondola holders 13. Also, removal of pairs of skis is more difficult if the slope of the tracks 12 is excessive so as to cause inordinate pressure on adjacent ski tips causing jamming. Conversely, if the slope of the floor causes the gondola holders 13 to move away from the point of access 11*a*, leveling means 16 compensate to slope the tracks 12 such that the gondola holders 13 will move toward the point of access 11*a*.

To enable the gondola holders 13 to move along the tracks 12, conventional roller means, designated generally as 17, may be attached at one end of each gondola holder 13 for operable engagement with the tracks 12. The other end of each gondola holder 13 is structured to hold a pair of skis. However, each gondola holder 13 could also be structured to hold a plurality of pairs of skis.

In the preferred embodiment, each gondola holder 13 includes a hingedly mounted pair of arms 18, 19 to straddle a pair of skis, thereby suspending them by their tips. These arms 18, 19 are biased toward a vertical orientation to swing out of the way when unloaded to enable a pair of skis to be removed from the next gondola holder 13 without obstruction. A distal segment 19*a* of the arms 19 may be bent downward as shown. A pair of skis may be supported between the unbent segment 19*b* of the bent arm 19 and the other straight arm 18. When the skis are removed by lifting them, the arms 18, 19 swing up against the support 33, leaving the bent segment 19*a* projecting out, approximately normal the support 33. The segment 19*a* then acts as a catch or stop for loading a subsequent pair of skis into the gondola 13.

It is preferred that each gondola holder 13 be structured so that a pair of skis is suspended by its tips with its center of gravity approximately directly beneath the rollers 17. This arrangement minimizes wear to the rollers 17. For closer packing, the gondola holders 13 may also be structured and sized as shown in FIG. 1 such that adjacent gondola holder 13*a*, 13*b* terminate at different elevations, thereby to off-set (or stagger) the elevations of the tips of adjacent suspended pairs of skis. Although it is generally preferred that gondola holders 13 each hold a pair of skis approximately vertically beneath the tracks 12, they may be structured in various other ways. Normally, however, pairs of skis should be suspended with their centers of gravity approximately below the rollers 17.

As best illustrated by FIG. 1, applicant's ski magazine 11 includes a plurality of parallel tracks 12 attached to a rear support member 20 and a front support member 21. Spacing rods 22 are attached to the rear support member 20 at one end and to the front support member 21 at the other end to give added strength to the assembly. The front support member 21 is fastened to the top ends of two front legs 23, 24 and the bottom ends of the front legs 23, 24 are fastened to a front base 25 resting on the floor. The rear support member 20 is fastened to the top ends of two rear legs 26, 27 which are shown longer than the front legs 23, 24. The bottom ends of the two rear legs 26, 27 are fastened to a rear base 28 also resting on the floor. The top ends of two cross members 29, 30 are attached to the rear support member 20 and transversely connect to the rear base 28 to add rigidity to the magazine 11. A pair of connecting members 31, 32 attach to the front base 25 and the rear base 28 for maintaining their positions fixed with respect to the floor. Suspended from the tracks 12 are a plurality of gondola holders 13.

Figure 2:
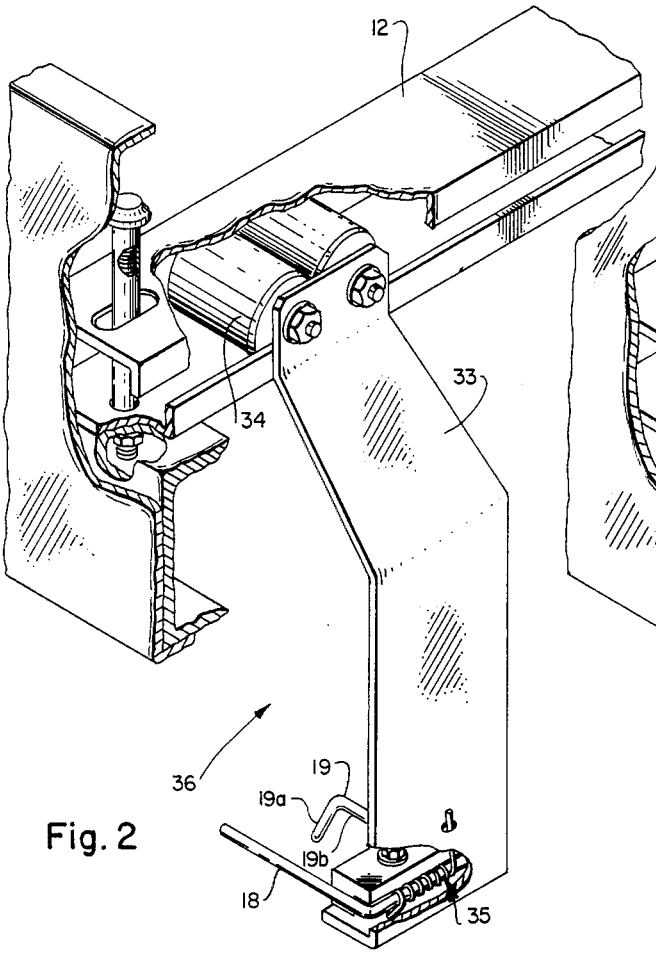
FIG. 2 is a fragmentary view, partially broken away, of a gondola holder suspended from a track.

As illustrated by FIG. 2, each gondola holder 13 comprises a suspending member 33 hung from rollers 34 at one end from a track 12. Hinged to the other end of the suspending member 33 are a pair of arms 18, 19 biased by a spring 35 upward in the direction of the arrow 36 to swing into position flat against the suspending member 33.

An alternative track and roller arrangement (not shown) utilizes a double rail (e.g., the track 12 illustrated rotated to orient the slot 12*a* downward) with a "railroad track" wheel assembly riding on the rails and suspending a gondola below the slot. Such an arrangement offers improved stability.

Figure 3:
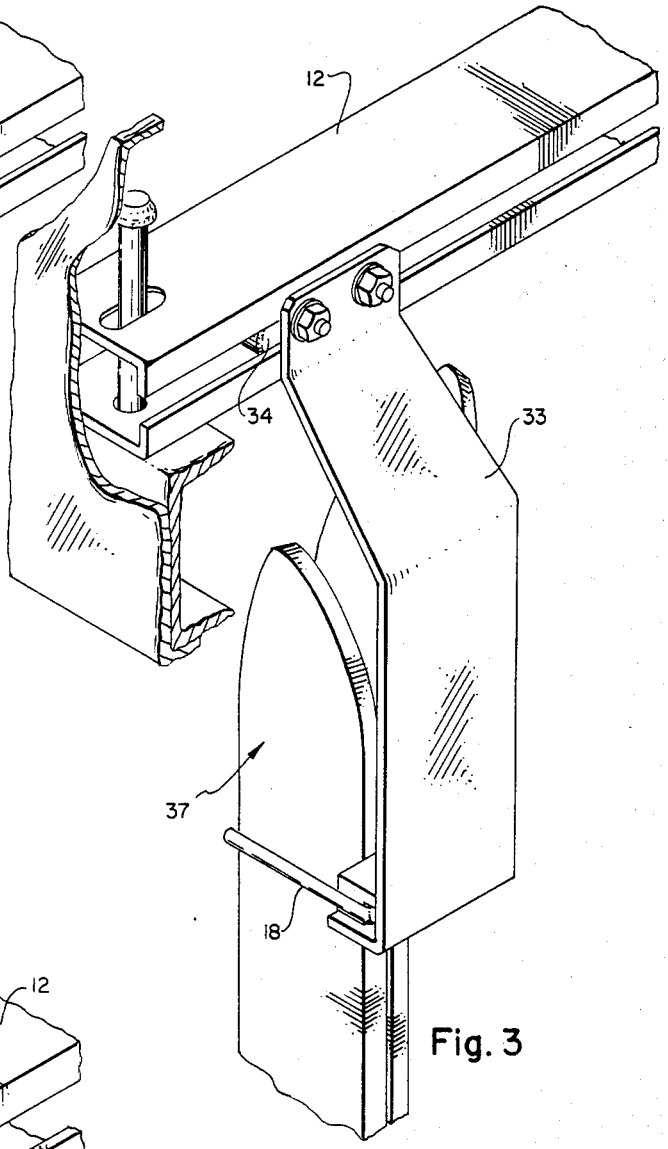
FIG. 3 is a fragmentary view, partially broken away, of a gondola holder supporting a pair of skis.

FIG. 3 illustrates a pair of skis designated 37 supported by their tips between a pair of arms 18, 19.

Figure 4:
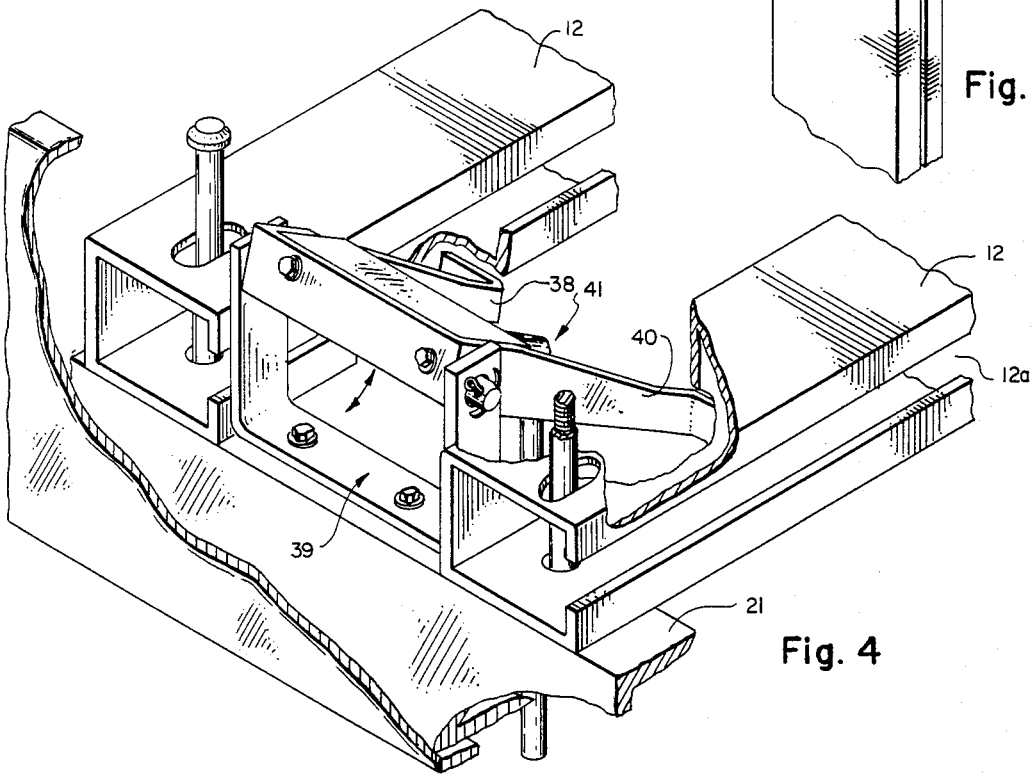
FIG. 4 is a fragmentary view, partially broken away, of a track leveler.

FIG. 4 illustrates generally a track leveler, designated generally as 38, attached to the front support member 21 used to adjust the pitch of the tracks 12 so that the gondola holders 13 will tend to move toward the point of access 11*a* of the magazine 11. Although various leveling means 16 may be used, the presently preferred track leveler 38 comprises a U-shaped bracket 39 attached to the front support member 21 and hinged to a lift member 40 which supports the tracks 12. A restraint 41 then locks the lift member 40 at the desired height to slope the track 12. It is also preferred that the storage and delivery magazine 11 be assembled with removable fasteners to enable it to be disassembled for easy storage when not in use.

In operation, pairs of skis, oriented bottom-to-bottom with ski tips facing opposite one another, are first sorted as to style and length. A particular style and length is then loaded onto a row of gondola holders 13, starting with the gondola holder 13*a* located rear most from the point of access 11*a* to the magazine 11, and sequentially loading thereafter subsequent gondola holders 13*b*, 13*c*, 13*d*, 13*e*, 13*f*, 13*g*, 13*h*, 13*i*, 13*j* until that particular stock of skis is exhausted or the row of gondola holders 13 is full. The loading of a pair of skis is accomplished by inserting them from the front 11*b* until they contact the segment 19*a*. The skis are then lowered. pulling the arms 18, 19 into straddling position (FIG. 3). The skis are then held suspended from their tips as shown.

Skis are removed from storage starting from the pairs suspended nearest the point of access 11*a* to the magazine 11. As a pair of skis is removed from a gondola holder 13*b*, the arms 18, 19 swing into position flat against the suspending member 33. This enables a subsequent pair of skis to be removed from the next gondola holder 13*a* without obstruction. The empty gondola holder 13*b* then moves toward the front of the magazine 11 the distance of the space formerly occupied by the tips of the removed pair of skis. The remaining loaded gondola holder 13*a* in the same row also moves toward the front 11*b* of the magazine 11 effecting a close packing of the skis still in storage.

Although this disclosure has made reference to the illustrated embodiment, various types of gondola holders 13 and support means to hold pairs of skis may be used. For example, pairs of skis may be held by the bottoms rather than the tips by modifying the holding means. The tracks 12 may, but need not be, parallel. Nor do the tracks 12 have to be the same size. A face plate 42 for advertising may be attached to the front support member 21 as illustrated in FIG. 1.

It is therefore not intended that the illustrated embodiment impose any limitations on the scope of the appended claims, which themselves recite those details regarded as essential to the invention.

I claim:

1. A storage and delivery magazine for skis which comprises:

a plurality of tracks;

a plurality of gondola holders, each including a pair of arms hingedly mounted to hold a pair of skis between said arms by their tips suspended approximately vertically therefrom and biased toward a vertical orientation to swing out of the way to enable a pair of skis to be removed from the next gondola holder without obstruction, each gondola holder being suspended from a said track for movement along said track, including roller means at one end in operable engagement with a track, the other end of each gondola being structured to hold skis; and means for holding said tracks sufficiently above a base that the suspended skis are held out of contact above the base.

2. A storage and delivery magazine according to claim 1, wherein one of each pair of arms is bent downward at a point along its length such that a pair of skis may be supported between the unbent segment of the bent arm and the other straight arm, or removed by sliding the pair of skis toward the distal ends of the arms and down along the bent segment of said bent arm.

3. A storage and delivery magazine according to claim 2, wherein each gondola holder is structured to suspend a pair of skis near their centers of gravity to minimize wear to the tracks.

4. A storage and delivery magazine according to claim 2, wherein the gondola holders are adapted to offset the tips of loaded skis for closer packing.

5. A storage and delivery magazine for skis, comprising:

a plurality of gondola holders suspended from a series of approximately parallel tracks such that the gondola holders are arranged in rows with the gondola holders of each row associated with a track and movable along that track towards an access point;

each gondola holder including structure to hold at least one pair of skis suspended approximately vertically beneath the level of the track with which that gondola holder is associated;

said structure including a pair of arms biased toward a vertical orientation but adapted to swing to a ski-holding orientation so that a pair of skis may be positioned between them for suspension in said magazine.

6. A storage and delivery magazine according to claim 5 wherein the access point of an individual track is at one end of the magazine, and said track is sloped so that the gondola holders associated therewith tend to move along the track toward said access point.

7. A storage and delivery magazine according to claim 6 wherein the access points of all of the tracks in the magazine are located at a common end of the magazine and all of the tracks are sloped so that the gondola holders associated with each track tend to move toward said common end.

8. A storage and delivery magazine according to claim 7 wherein each gondola holder includes roller means in operable engagement with said track with which it is associated.

9. A storage and delivery magazine according to claim 8 wherein individual gondola holders include a pair of arms adapted to suspend a pair of skis from their tip ends, the weight of said skis holding said arms in a non-vertical, loaded orientation until said skis are removed, whereafter said arms swing back to their said vertical orientation.

* * * * *